US006490864B1

(12) United States Patent
Joos et al.

(10) Patent No.: US 6,490,864 B1
(45) Date of Patent: Dec. 10, 2002

(54) BURNER WITH DAMPER FOR ATTENUATING THERMO ACOUSTIC INSTABILITIES

(75) Inventors: Franz Joos, Weilheim-Bannholz (DE); Alexander Ni, Baden (CH); Wolfgang Polifke, Freising (DE)

(73) Assignee: ALSTOM (Switzerland) Ltd, Baden (CH)

( * ) Notice: Subject to any disclaimer, the term of this patent is extended or adjusted under 35 U.S.C. 154(b) by 17 days.

(21) Appl. No.: 09/684,982

(22) Filed: Oct. 10, 2000

(30) Foreign Application Priority Data

Oct. 8, 1999 (DE) ..... 199 48 674

(51) Int. Cl.[7] ..... F02C 7/24
(52) U.S. Cl. ..... 60/725; 60/737; 60/738
(58) Field of Search ..... 60/725, 737, 738

(56) References Cited

U.S. PATENT DOCUMENTS 4,932,861 A * 6/1990 Keller et al. ..... 431/8
5,154,059 A * 10/1992 Keller ..... 60/737
5,274,993 A * 1/1994 Keller ..... 60/39.37
5,375,995 A * 12/1994 Dobbleling et al. ..... 431/8
6,098,406 A * 8/2000 Bolis et al. ..... 60/737
6,270,338 B1 * 8/2001 Eroglu et al. ..... 431/8

FOREIGN PATENT DOCUMENTS

| | | |
|---|---|---|
| AT | 398 343 | 9/1994 |
| DE | 33 24 805 | 1/1985 |
| DE | 44 39 619 | 5/1996 |
| DE | 195 04 610 | 8/1996 |
| DE | 196 36 093 | 3/1998 |
| DE | 198 09 364 | 9/1998 |
| DE | 197 23 367 | 11/1998 |
| EP | 0 650 015 | 4/1995 |
| JP | 0007280270 | 2/1994 |
| WO | 93/10401 | 5/1993 |

* cited by examiner

*Primary Examiner*—Charles G. Freay
*Assistant Examiner*—William Rodriguez
(74) *Attorney, Agent, or Firm*—Burns, Doane, Swecker & Mathis, L.L.P.

(57) ABSTRACT

In a combustion apparatus (10), in particular for driving gas turbines, in which combustion apparatus (10) a gaseous fuel in a burner (11) is sprayed through a plurality of separate fuel-injection devices (15, 16) into a gas flow containing combustion air, and the resulting mixture flows into a combustion chamber (12) for combustion and burns there, the acoustic impedance or stiffness of the fuel-injection devices (15, 16) is selected to be different in order to avoid thermoacoustic combustion instabilities.

6 Claims, 1 Drawing Sheet

BURNER WITH DAMPER FOR ATTENUATING THERMO ACOUSTIC INSTABILITIES

BACKGROUND OF THE INVENTION

The present invention relates to the field of combustion technology. It concerns a combustion apparatus, in particular for driving gas turbines, in which combustion apparatus a gaseous fuel in a burner is sprayed through a plurality of separate fuel-injection devices into a gas flow containing combustion air, and the resulting mixture flows into a combustion chamber for combustion where the mixture is burned.

U.S. Pat. No. 4,932,861, for example, discloses such a combustion apparatus, which is based in particular on a double-cone burner.

Thernoacoustic combustion instabilities can seriously impair safe and reliable operation of modern gas turbines with premixing. One of the mechanisms responsible for these instabilities is based on a feedback loop which includes the pressure and velocity fluctuations during the fuel-injection, the (convective) fuel in homogeneity transported by the flow, and the heat-release rate.

A fundamental stability criterion for the occurrence of thermnoacoustic combustion instabilities is the Rayleigh criterion, which can be formulated as follows:

As soon as a flame is enclosed in an acoustic resonator, thermoacoustic self-excited vibrations may occur if $$\int_0^{\tau} Q' p' dt > 0 \tag{1}$$

where Q' is the instantaneous deviation of the integral heat-release rate from its average (steady) value, p' designates the pressure fluctuations, and T designates the period of the vibrations (1/T=f is the frequency of the vibrations). In the formula (1), it is assumed that the spatial extent of the heat-release zone is sufficiently small in order to work with integral values of Q' and p'. Extension to the general situation with a distributed heat-release rate Q' (x) and a small acoustic wavelength is obtained directly and leads to a so-called Rayleigh index. The Rayleigh criterion (1) states that, an instability can only occur if fluctuations in the heat release and in the pressure are at least in phase up to a certain degree.

In a combustion apparatus with premixing, the instantaneous heat-release rate depends, inter alia, on the instantaneous fuel concentration in the premixed fuel/air mixture which enters the combustion zone. The fuel concentration in turn may be influenced by (acoustic) pressure and velocity fluctuations in the vicinity of the fuel-injection device, provided that the air feed and the fuel-injection device are not acoustically stiff. This last-mentioned condition is normally fulfilled, i.e. the pressure drop of the air flow along the fuel-injection region of the burner is normally quite small, and even the pressure drop along the fuel-injection device is generally not large enough in order to uncouple the fuel-feed line from the acoustics in the combustion apparatus. The relationship between the acoustics at the fuel-injection device and the heat release in the flow can be formulated with the simplest expressions as follows:

$$\frac{Q'(t)}{Q} = \frac{u'(x_1, t-\tau)}{u(x_1)} - \frac{1}{2}\frac{p'(x_1, t-r)}{\Delta p} \tag{2}$$

where x, designates the location of the fuel-injection and u(x) and u' (x) designate the flow velocity and, respectively, its instantaneous time change, whereas $\tau$ designates the time delay, which expresses the fact that fuel in homogeneity which occurs at the fuel-injection device is not immediately felt at the flame but only after it has been transported by the average flow from the injection location to the flame front. In a self-igniting combustion apparatus, $\tau$ is determined by the kinematics of the chemical reactions, which determine the location of the flame. In a conventional combustion apparatus with premixing, however, the flame is anchored with a flame holder, which may assume different configurations (bluff body, V-gutter, recirculation zone or the like). In this case, the time delay depends on the average flow velocity and the distance between injection location and flame holder. In each case, the time delay can be described approximately by $$\tau = \int_0^l \frac{dx}{U(x)} \tag{3}$$

where l designates the distance between the injection location and the flame front, whereas U(x) is the average flow velocity in the premix zone of the burner, with which average flow velocity the fuel in homogeneity in the flow is transported from the injection device to the flame.

In summary, it may be stated that the equation (2) expresses the fact that an instantaneous increase in the velocity of the air flowing past the fuel-injection device (first term on the right-hand side of the equation) leads to a dilution of the fuel/air mixture and to a corresponding reduction in the heat release, whereas a pressure increase at the fuel-injection device (second term on the right-hand side of the equation) reduces the instantaneous fuel mass flow and thus likewise reduces the heat-release rate. Even if the fuel-injection device is acoustically "stiff" (i.e. $\Delta \rightarrow \infty$) - fuel in homogeneity can be produced at the injection device.

As far as the thermoacoustic stability is concerned, a time delay, as occurs in equation (2), generally permits a resonant feedback and an amplification of infinitesimal disturbances. Of course, the exact conditions and frequencies during which self-excited vibrations occur also depend on the average flow conditions, to be precise in particular on the flow velocities and temperatures, and on the acoustics of the combustion apparatus, such as, for example, the boundary conditions, natural frequencies, damping mechanisms, etc. Nonetheless, the relationship between the acoustic properties and the fluctuations in the heat release, as described in equation (2), constitute a serious threat to the thermoacoustic stability of the combustion apparatus. A way of suppressing this mechanism from the very start is therefore desirable.

In principle, it is conceivable within the limits of the above-mentioned considerations to suppress thermoacoustic instabilities by a distribution of different time delays on the time axis. In this case, the injected fuel is split up into two or more individual flows or "lots" which all have different time delays and correspondingly different phases with respect to one another. Ideally, such splitting-up into various fuel flows should result in fluctuations in the heat release $Q_i$ (i=1, 2, . . . ) in such a way that $$\sum_i \int_0^T Q_i(t)dt = 0 \tag{4}$$

would apply. This would ensure that the Rayleigh criterion (1) cannot be fulfilled. In practice, such an exact extinction is neither possible nor necessary; it is sufficient to reduce the intensity of the resonant feedback to such an extent that the dissipative effects within the system are greater than the amplification mechanisms.

It has been proposed (DE-A1-198 09 364), for a burner or a plurality of burners working in parallel in a combustion chamber, to inject fuel in an axially graduated manner at different axial distances from the location of the heat release in order to uncouple the fuel from the combustion and reduce the dynamic pressure amplitude of the combustion flame. However, such a solution has the disadvantage that the desired graduated fuel-injection requires complicated equipment to achieve the axial graduation. This is because, if fuel is injected in an axially graduated manner inside a burner, a plurality of separate injection openings arranged one behind the other are necessary. On the other hand, if a plurality of parallel burners having different axial injection locations are used, the burners must be produced individually on account of their different configurations, which makes manufacture and stock-keeping considerably more expensive.

SUMMARY OF THE INVENTION

In one aspect of the invention, a combustion apparatus is provided that achieves a distribution of delay times in the injection of fuel without having to change the location of fuel injection.

The various fuel-injection devices are provided with different acoustic impedance or stiffness with respect to the acoustic signal outside the spray devices, resulting in a different phase of the fluctuations in the fuel mass flow. In this case, the quasi-steady assumptions which are expressed by the second term on the right-hand side of equation (2) are no longer appropriate. On the contrary, a detailed description of the acoustic system of the fuel supply is necessary in order to obtain a sufficiently accurate description of the dynamic properties. Nonetheless, the principle is clear: if the fuel-injection device is acoustically sufficiently "soft" and the frequency of the excitation, i.e., the pressure signal $p'(x_1)$, lies close to the natural frequency of the fuel inlet, a phase displacement develops between the excitation and the response. Of particular interest here is the case where the natural frequency of a fuel-injection device lies above the excitation frequency, and the natural frequency of another fuel-injection device lies below this natural frequency. The fluctuations in the fuel-spraying would be exactly in phase opposition in this case.

In a preferred embodiment of the combustion apparatus according to the invention, the fuel-injection devices each have a predetermined pressure drop of the fuel, and the pressure drop is selected to be different for at least two fuel-injection devices in order to realize the different acoustic impedances of the fuel-injection devices. This embodiment has the advantage that no changes are necessary in the fuel-distribution system located upstream of the fuel-injection devices.

Another preferred embodiment is distinguished by the fact that the fuel-injection devices are each supplied with fuel by a separate fuel-distribution line, and additional means which vary or set the acoustic impedance of the fuel-injection devices are provided in the fuel-distribution lines. This embodiment has the advantage that the spraying devices can remain unchanged, since the requisite changes are made in the fuel-distribution system located upstream. In this case, the additional means for varying the acoustic impedance may comprise, in particular, resonance cavities which are arranged in the fuel-distribution lines. Resonance cavities of the same type can be arranged in all the fuel-distribution lines, with the different acoustic impedance for various fuel-injection devices being achieved by positioning the resonance cavities at different distances from the fuel-injection devices. Alternatively, different acoustic impedance for different fuel-injection devices can be achieved by arranging resonance cavities only in selected fuel-distribution lines. A suitable burner, in particular, is a double-cone burner, as has been developed and successfully used by the applicant, and as described in detail in U.S. Pat. No. 4,932,861, which is herein incorporated by reference.

DESCRIPTION OF THE DRAWINGS

The invention is explained in more detail below with reference to exemplary embodiments in connection with the drawings, in which.

DETAILED DESCRIPTION OF THE PREFERRED EMBODIMENTS

The acoustic stiffness of a fuel-injection device is primarily determined by the pressure drop through the device. Thus, for example, the change m' in the mass flow m for given pressure fluctuations p' is in inverse proportion to the pressure drop Δp in the fuel-injection device $$\frac{m'}{m} \propto \frac{1}{2}\frac{p'}{\Delta p} \tag{5}$$

From this it follows that a pronounced pressure drop Δp always acoustically uncouples the fuel-injection system from the acoustic properties of the burner or the combustion chamber.

However, the pressure drop Δp in the fuel-injection device is in principle limited, so that it is not always possible to uncouple the acoustics of the fuel supply. In this case, the impedance (acoustic stiffness) of the fuel-injection device can be varied by installing resonance cavities in the fuel-distribution lines leading to the individual fuel-injection devices. These cavities result in an acoustic closure of the fuel-supply lines, so that the distance between the resonance cavity and the spray opening for the fuel, in each case for a predetermined frequency, determines the impedance of the fuel-injection device.

Figure 1:
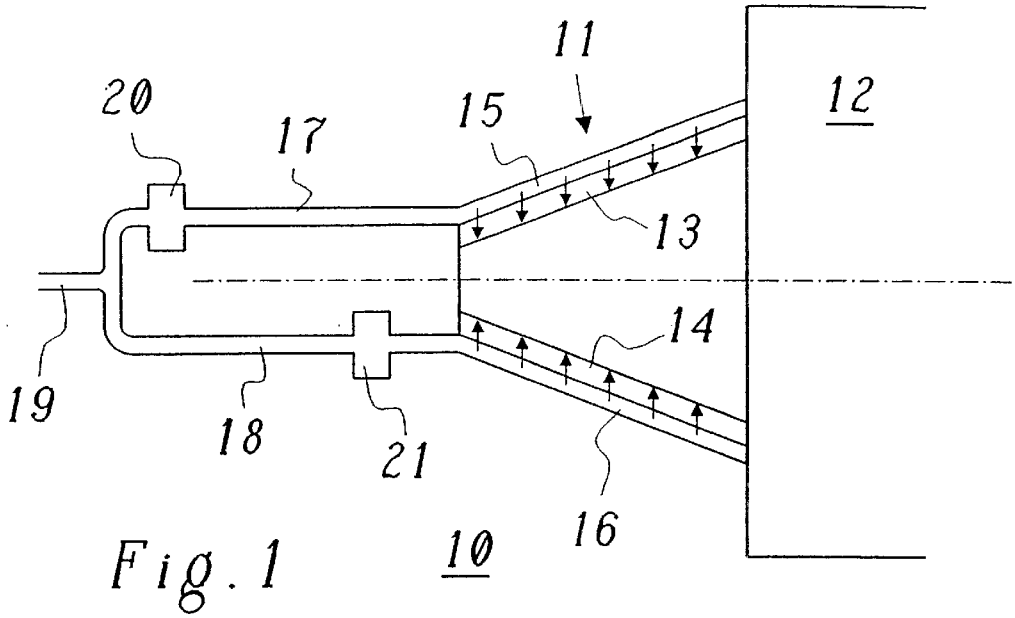
FIG. 1 shows a schematic longitudinal section of a first preferred embodiment of a combustion apparatus according to the invention with a double-cone burner and resonance cavities in each of the fuel-distribution lines.
Figure 2:
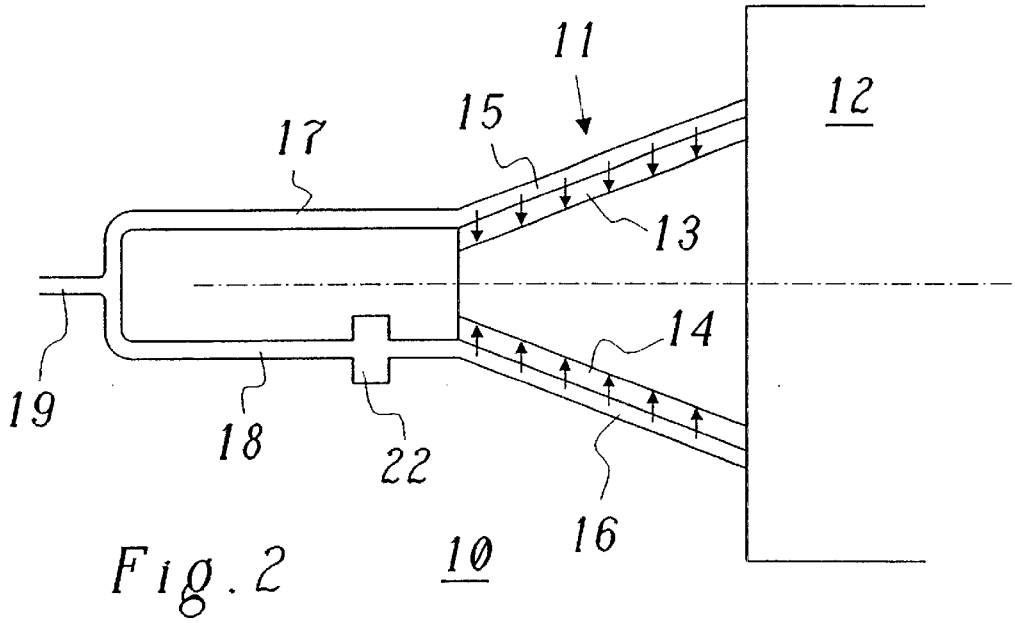
FIG. 2 shows an exemplary embodiment comparable with FIG. 1 in which resonance cavities are arranged only in selected fuel-distribution lines.

A different acoustic stiffness and thus a different delay time in the heat release can now be achieved by virtue of the fact that either (1) the pressure drop Δp from one fuel-injection device to the next is varied, or (2) resonance cavities are installed in all the fuel-distribution lines leading to the fuel-injection devices and the distances between the spray openings and the resonance cavities are in each case selected to be different (FIG. 1), or (3) resonance cavities are installed only in some of the fuel-distribution lines leading to the fuel-injection devices (FIG. 2).

A different pressure drop according to variant (1) can be realized in many different ways, e.g. by selecting the nozzle diameters to be different, the actual measures at the fuel-injection devices depending to a very great extent on the construction of the respective device. An exemplary embodiment is therefore not specified for this variant.

For the variant (2), reference may be made to the representation in FIG. 1. As shown in FIG. 1, a combustion apparatus 10 (greatly simplified) comprises a double-cone burner 11 working in a combustion chamber 12, as described in detail, for example, in U.S. Pat. No. 4,932,861. In the double-cone burner 11, combustion air passes from outside through two tangential air-inlet slots 13 and 14 into the interior of the conical burner part where a vortex is formed. In the region of the air-inlet slots 13 and 14, gaseous fuel is sprayed in each case through a fuel-injection device 15 and 16, respectively, in the direction of the arrows depicted in FIG. 1 into the air flow entering through the air-inlet slots 13 and 14. The air/fuel mixture forming in the vortex then discharges into the adjoining combustion chamber 12, where it ignites and burns with a flame. Each of the fuel-injection devices 15, 16 is supplied with fuel via a separate fuel-distribution line 17 or 18, respectively, from a common fuel-feed line 19. Arranged in each of the fuel-distribution lines 17, 18 is a resonance cavity 20 or 21, respectively, which is at a different distance from the double-cone burner 11 or the spray openings arranged in the burner. In the example of FIG. 1, the top resonance cavity 20 is farther away from the burner than the bottom resonance cavity 21. As described above, the different distances from the resonance cavities to the corresponding fuel-injection devices results in a different acoustic impedance of the respective spray system. This variation of acoustic impedances for different fuel-injection devices has a desired effect on the thermnoacoustic combustion instabilities. In this case, no change need be made to the double-cone burner 11 itself.

In the variant (3) shown by way of example in FIG. 2, a structure comparable with FIG. 1 is obtained, with like features being represented by the same reference numerals. A difference is that only some fuel-distribution lines—in this case the bottom fuel-distribution line 18, are provided with an impedance-determining resonance cavity 22. The desired different impedances can also be realized in this way, simplifications and savings being possible due to the omission of some of the resonance cavities.

On the whole, the invention results in a means of effectively suppressing thermoacoustic instabilities during the combustion by minimal changes in the fuel-spray system.

What is claimed is:

1. A combustion apparatus for driving gas turbines, comprising:

a burner, said burner including a plurality of fuel-injection devices through which a gaseous fuel is sprayed, the fuel-injection devices each being connected to a separate fuel-distribution line for supplying fuel to the fuel-injection devices, and means for varying or setting acoustic impedances of each of the fuel-injection devices being provided in the fuel-distribution lines; and a combustion chamber for combustion of a mixture resulting from the gaseous fuel mixed with combustion air, wherein the acoustic impedance of each of the fuel-injection devices is selected to be different in order to avoid thermoacoustic combustion instabilities.

2. The combustion apparatus as claimed in claim 1, wherein the means for varying or setting the acoustic impedances comprise resonance cavities which are arranged in the fuel-distribution lines.

3. The combustion apparatus as claimed in claim 2, herein resonance cavities of the same type are arranged in all the fuel-distribution lines, and different acoustic impedances for each of the fuel-injection devices are set by each of the resonance cavities being positioned at a different distance from the corresponding fuel-injection devices.

4. The combustion apparatus as claimed in claim 2, wherein different acoustic impedances for different fuel-injection devices are produced by arranging resonance cavities only in selected fuel-distribution lines.

5. The combustion apparatus as claimed in claim 1, wherein the burner is designed as a double-cone burner.

6. A combustion apparatus for driving gas turbines, comprising:

a burner, said burner including a plurality of fuel-injection devices through which a gaseous fuel is sprayed, the fuel-injection devices each being designed with a passageway through which the fuel passes at a predetermined pressure drop, and the pressure drop of the fuel through each of the fuel-injection devices being different as a result of the design of the passageway such that an acoustic impedance of each of the fuel-injection devices is different; and a combustion chamber for combustion of a mixture resulting from the gaseous fuel mixed with combustion air, wherein the acoustic impedance of each of the fuel-injection devices is selected to be different in order to avoid thermoacoustic combustion instabilities.

* * * * *